US005421423A

United States Patent [19]

Huffstutler

[11] Patent Number: 5,421,423

[45] Date of Patent: Jun. 6, 1995

[54] ROTARY CONE DRILL BIT WITH IMPROVED CUTTER INSERT

[75] Inventor: Alan D. Huffstutler, Grand Prairie, Okla.

[73] Assignee: Dresser Industries, Inc., Dallas, Tex.

[21] Appl. No.: 216,631

[22] Filed: Mar. 22, 1994

[51] Int. Cl.[6] ..... E21B 10/16; E21B 10/52

[52] U.S. Cl. ..... 175/374; 175/426

[58] Field of Search ..... 175/374, 426

[56] References Cited

U.S. PATENT DOCUMENTS

| | | | |
|---|---|---|---|
| 2,038,386 | 3/1935 | Scott et al. | 255/71 |
| 2,148,372 | 3/1936 | Garfield | 255/71 |
| 2,571,930 | 10/1946 | Noble | 255/71 |
| 2,687,875 | 11/1951 | Morland et al. | 255/346 |
| 3,134,447 | 1/1962 | McElya et al. | 175/332 |
| 3,137,355 | 6/1964 | Schumacher, Jr. | 175/374 |
| 3,250,337 | 5/1966 | Demo | 175/343 |
| 3,389,761 | 6/1968 | Ott | 175/374 |
| 3,442,342 | 5/1969 | McElya et al. | 175/374 |
| 3,495,668 | 2/1970 | Schumacher, Jr. | 175/341 |
| 3,599,737 | 8/1971 | Fischer | 175/374 |
| 3,749,190 | 7/1973 | Shipman | 175/410 |
| 4,047,583 | 9/1977 | Dyer | 175/410 |
| 4,086,973 | 5/1978 | Keller et al. | 175/374 |
| 4,176,725 | 12/1979 | Shields | 175/374 |
| 4,254,840 | 3/1981 | Shay, Jr. | 175/410 |
| 4,271,917 | 6/1981 | Sahley | 175/410 |
| 4,420,050 | 12/1983 | Jones | 175/374 |
| 4,595,067 | 6/1986 | Drake | 175/374 X |
| 4,597,456 | 7/1986 | Ecer | 175/426 X |
| 4,716,977 | 1/1988 | Huffstutler | 175/426 |
| 5,201,376 | 4/1993 | Williams | 175/374 |
| 5,322,138 | 6/1994 | Siracki | 175/374 |

FOREIGN PATENT DOCUMENTS

| | | | |
|---|---|---|---|
| 244980 | 10/1969 | U.S.S.R. | 175/374 |
| 309110 | 9/1971 | U.S.S.R. | 175/374 |
| 1488427 | 6/1989 | U.S.S.R. | 175/426 |

OTHER PUBLICATIONS

*Rock Bit Technology Manual,* Security Division, Dresser Industries.

*Security Rock Bits, Rock Bit Technology,* "Chapter 2, Roller Cone Bit Design".

"Field Performance of Hydrodynamically Lubricated Bearing Seal for Rock Bits", J. W. Langford and M. S. Kaisi, IADC/SPE Drilling Conference, 1990.

Security Division, Dresser Industries, Inc., "Security Double Seal Bits".

Security Division, Dresser Industries, Inc., "New HF-148 Tooth Hardfacing on Security Journal Bearing and Double Seal Tooth Bits", #6365.

*Primary Examiner*—Hoang C. Dang

*Attorney, Agent, or Firm*—Baker & Botts

[57] ABSTRACT

A cutter insert (34) is designed for mounting within a socket (48) bored in a roller cone cutter (10,12,14). The insert (34) includes a base (52) having a length (L2), a width (W2), and a depth (D), where the length (L2) differs substantially from the width (W2). The base (52) is sized to have an interference fit with the socket (48). A cutting tip (54) is integrally formed with the base (52) and protrudes outwardly from the socket (48) when the base (52) is mounted therein. The noncylindrical base (52) and socket (48) prohibit rotation of the insert (34) within the socket (48). Additionally, more inserts (34) with noncylindrical bases (52) can fit in a row (28–32, 36–46) than can cylindrical inserts having cylindrical bases and cutting tips of similar dimensions.

20 Claims, 3 Drawing Sheets

ROTARY CONE DRILL BIT WITH IMPROVED CUTTER INSERT

TECHNICAL FIELD OF THE INVENTION

This invention relates generally to earth boring equipment and more specifically to cutter inserts for installation in a cone cutter associated with rotary cone drill bits.

BACKGROUND OF THE INVENTION

It is often desirable to bore through a hard earth formation with a drill bit having roller cone cutters designed to scrape and gouge the formation. A cone cutter having broad, flat milled teeth can very effectively scrape and gouge such formations. However, because milled teeth are formed integrally with the surface of the cone cutter, they are typically formed from materials that wear quickly while boring through hard formations. Even when coated with an abrasion-resistant material, milled teeth often crack or break when they encounter hard formations. Thus, milled teeth are typically unsuitable for boring through hard earth formations.

To replace milled teeth in hard-formation cone cutters, engineers developed cylindrical cutter inserts that are formed from a hard, abrasion-resistant material such as sintered and compacted tungsten carbide. Typically, such inserts or compacts have a generally frustoconical or chisel-shaped cutting portion and a cylindrical base. The base is fitted into a socket, which is drilled into the exterior of the roller cone cutter, such that the cutting portion protrudes from the exterior of the associated cone cutter.

Cone cutters having hard-earth cylindrical inserts with frustoconical cutting portions tend to crush the formation instead of scraping and gouging it. Thus, although less prone to wear and breakage than milled teeth, hard-earth inserts having frustoconical cutting portions do not provide the desired cutting action.

Cone cutters having hard-earth cylindrical inserts with chisel-shaped cutting portions often cannot scrape and gouge a hard earth formation as effectively as cone cutters having milled teeth. Within a row of cutter inserts, the sockets are separated by a minimum distance or clearance in order that expected drilling forces do not deform the sockets. Such deformation might allow the insert to rotate within or become dislodged from its respective socket. Because of this minimum distance and because the length of the chisel crest is limited by the diameter of the insert's cylindrical base, cylindrical inserts often cannot be made with chisel crests long enough to provide a scraping and gouging action that is as effective as that provided by milled teeth.

Because of the cylindrical shape of the base and socket, a cylindrical insert may tend to rotate within its socket. This rotation may orient a chisel-shaped cutting portion so as to further reduce the gouging and scraping effectiveness and the penetration rate of the cone cutter. Furthermore, such rotation over an extended period may dislodge the insert from the socket. Following are examples of prior cutter inserts.

U.S. Pat. No. 3,599,737 to John F. Fischer, patented Aug. 17, 1971, discloses a hardened metal insert with out-of-round abutment portions. The inserts are press-fitted into respective sockets formed in the associated cone cutter. Then, the cone cutter surface adjacent the abutment portions is staked to displace metal into the abutment portions to prevent axial and rotational displacement of the insert. Providing the abutment portions and the staking represent additional manufacturing steps. Furthermore, the frustoconical cutting portion provides a crushing action instead of a scraping and gouging action.

U.S. Pat. No. 3,749,190 to Clarence S. Shipman, patented Jul. 31, 1973, discloses a tapered carbide button insert. The button insert is fitted into a socket formed in a rock drill bit. A sleeve is then forced into the gap between the insert and the socket wall and extruded into an undercut of the socket. By virtue of its shear strength, the sleeve retains the insert in the socket.

However, the installation of the sleeve represents an additional manufacturing step, and, the button insert fails to provide a scraping and gouging action.

U.S. Pat. Nos. 4,406,337 to Herbert C. Dill, patented Sep. 27, 1983, discloses a cutter insert having at least two projections protruding from the bottom of its base. When the insert is fully pressed into a respective socket, the projection becomes embedded in the socket bottom to prevent rotation of the insert.

However, if the insert dislodges enough to disengage the projections from the socket bottom, the projections can no longer prevent rotation of the insert. Furthermore, the chisel crest is constrained to a shorter-than-desired length by the diameter of the insert base.

U.S. Pat. No. 3,389,761 to Eugene G. Ott, patented Aug. 26, 1968, discloses a carbide insert having alternate ridges and valleys sized to engage the socket walls. The interference between the ridges and the socket walls helps to prevent the insert from rotating within the socket, and thus helps to retain the insert within the socket.

However, with continued use, the interference between the ridges and the socket walls may weaken to a level insufficient to prevent rotation of the insert. Again, the crest length is limited by the diameter of the cylindrical insert base.

Other inserts are disclosed in U.S. Pat. Nos. 4,047,583; 4,420,050; 4,271,917; 4,254,840; 4,176,725; and 4,086,973. These inserts have shortcomings similar to those described above.

None of the above-mentioned references have provided a way of increasing the crest length of the insert's chisel portion without increasing the diameter of the insert's base, and hence, without decreasing the maximum possible number of inserts within an annular row. Furthermore, none of the above-mentioned references have provided means for efficient manufacturing of a cone cutter with inserts while preventing rotation of such inserts within their respective sockets.

SUMMARY OF THE INVENTION

In accordance with one aspect of the present invention, an insert is provided for mounting within a socket formed in a roller cone cutter. The insert includes a base having a length, a width, and a depth, where the length differs substantially from the width. The base is preferably sized to have an interference fit with the respective socket. A cutting tip may be integrally formed with the base and protrudes outwardly from the socket when the insert is mounted therein.

In accordance with a related aspect of the present invention, an insert formed from hard metal is provided. The hard-metal insert includes a base sized to be received within the socket with an interference fit. The base includes a top, a bottom surface, a front surface extending between the bottom surface and the top, and a rear surface opposite the front surface and extending between the bottom surface and the top. The base also includes opposing side surfaces extending between the front, rear, and bottom surfaces and the top. The minor axis of the base extends between the front and rear surfaces, and the major axis, which is substantially longer than the minor axis, extends between the opposing side surfaces. The hard-metal insert may include a chisel portion integrally formed with the base. The chisel portion preferably includes front and rear flank edges extending and converging outwardly from the top. A crest having opposing ends is formed at the convergence. The crest is parallel with and substantially shorter than the major axis. A pair of opposing end surfaces each extends between the flank surfaces, one of the opposing ends, and the top.

In accordance with another aspect of the invention, a cone cutter is provided for rotating about a spindle of a rotary cone drill bit. The cone cutter has a longitudinal axis and a surface. A plurality of sockets are arranged in at least one row that is disposed along the surface. Each of the sockets has major and minor axes, where the minor axis is substantially shorter than the major axis. A plurality of inserts are each mounted with an interference fit within respectively one of the sockets. Each of the inserts includes a base having a length, a width, and a first depth where the length is substantially unequal to the width. A cutting tip may be integrally formed with the base and protrude outwardly from the respective socket.

In accordance with still another aspect of the invention, a method is provided for forming an oblong socket in the exterior of a cone cutter. The socket is preferably sized to receive the base of an insert where the base has a first depth, a first width, and a first length and the socket has a second depth, a second width, and a second length. The method includes forming first and second holes in the exterior such that the holes each have an axis normal to the surface. The surface adjacent to the holes is then machined with a mill cutter tool. The mill cutter tool forms the second depth less than or equal to the first depth and forms the second width and the second length approximately equal to the first width and the first length such that the socket forms an interference fit with the base.

A technical advantage provided by one aspect of the present invention is that the noncylindrical shape of the base prohibits the rotation of the insert within the respective socket. Irregularities on the insert, such as protrusions or abutment portions, or additional manufacturing steps, such as staking or sleeving, are not required to prohibit such rotation.

Another technical advantage provided by the present invention is that the crest of a chisel-shaped cutting portion can have the desired length to approximate a milled tooth cutter without reducing the number of cutter inserts that can be placed within an annular row of a cone cutter. Because the width of the base is substantially shorter than the length of the crest, the desired number of inserts can be oriented within the row such that the desired minimum distance is maintained between each socket. That is, for the same socket depth, cutter tip length, and insert protrusion height, the width of a socket according to the present invention is substantially less than the diameter of a cylindrical socket for receiving a cylindrical insert. Therefore, the maximum possible number of inserts according to the present invention that can be placed in a row exceeds the maximum possible number of cylindrical inserts that can be placed in the same row.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–11 of the drawings, like numerals being used for like and corresponding parts of the various drawings.

Figure 1:
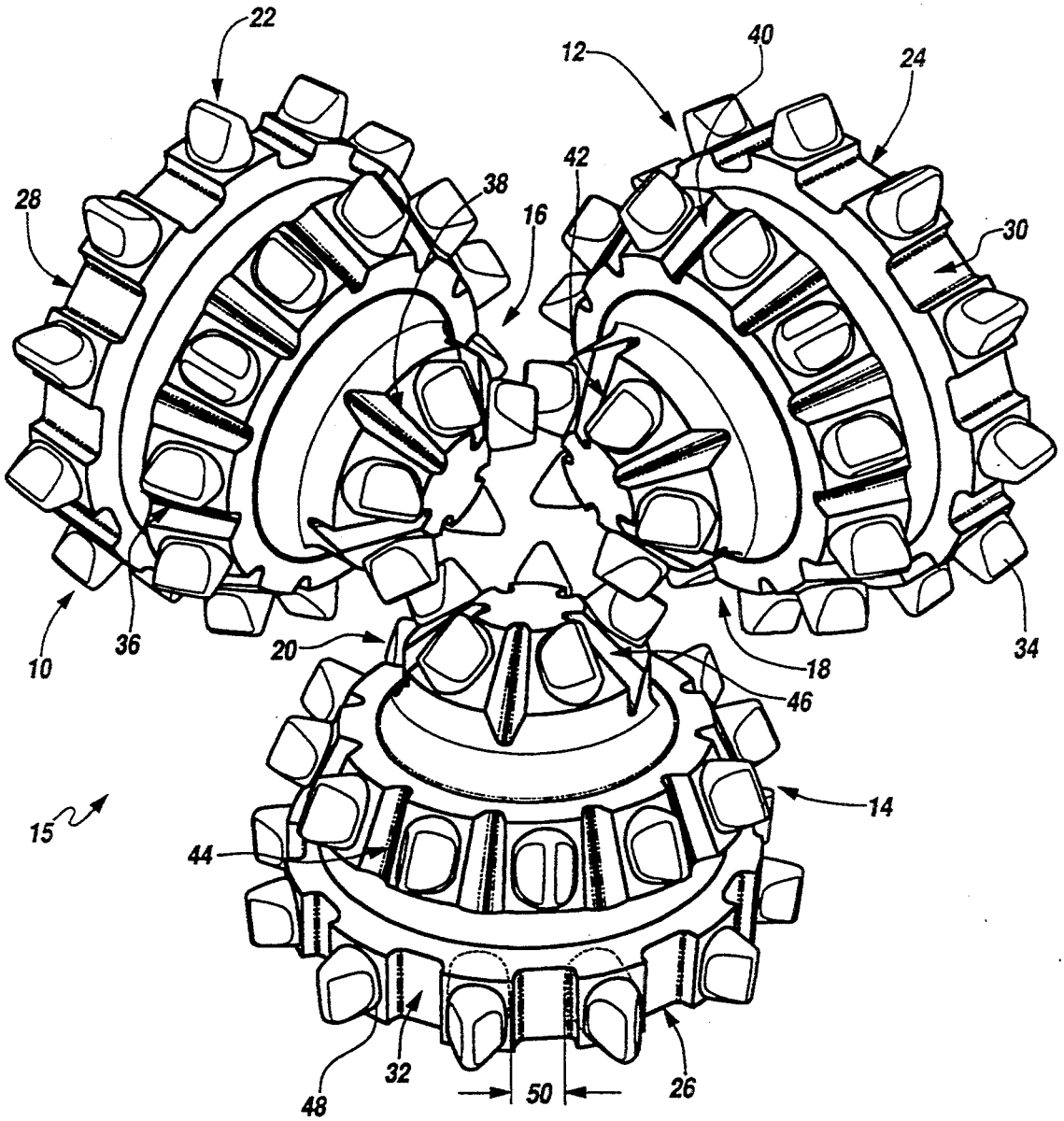
FIG. 1 is a perspective view with portions broken away of three cone cutters of a rotary cone drill bit embodying the present invention.

Referring to FIG. 1, a perspective view is shown of three similar cone cutters 10, 12, and 14 of a rotary cone drill bit 15. Cone cutters 10, 12, and 14 include nose portions 16, 18, and 20, which are oriented toward the axis of rotation for bit 15, and bases 22, 24, and 26, which are positioned at the intersection of the well-bore wall and bottom (not shown) during drilling. Each cone cutter 10, 12 and 14 also includes a cavity (not shown) which may be mounted on a spindle (not shown) to allow rotation of each cone cutter 10, 12 and 14 during drilling.

Cone cutters 10, 12, and 14 also include annular outer rows 28, 30, and 32 of oblong inserts 34 for cutting the intersection between the well-bore wall and bottom. Rows 28, 30, and 32 may be constructed in accordance with the present invention as described below and are adjacent to bases 22, 24, and 26. Cone cutters 10, 12, and 14 further include annular inner rows 36, 38, 40, 42, 44, and 46 of inserts 34 for destroying the inner portion of the well-bore. Typically, the cutting efficiency of cone cutters 10, 12, and 14 increases as the number of annular inner rows increases.

As shown, annular outer rows 28–30 and annular inner rows 36, 38, 40, 42, 44 and 46 lie along the surface of cone cutters 10–14 in paths that are concentric to the rotational, i.e., longitudinal axes of cones 10–14. Each insert 34 preferably has its major axis transversely, i.e., perpendicularly oriented with respect to the circumferential direction of the path of the row within which the insert lies. However, some or all of rows 28–30 and 36, 38, 40, 42, 44 and 46 may be nonconcentric to the longitudinal axes of cones 10–14. Also, some or all of rows 28–30 and 36, 38, 40, 42, 44 and 46 may not fully extend about the circumferences of cones 10–14. Furthermore, each of one or more inserts 34 may have its major axis obliquely oriented with respect to the path within which the insert lies.

Inserts 34 are preferably force fitted into their respective sockets 48, which are formed in the outer surfaces of cone cutters 10, 12, and 14. Thus, an interference fit between the base surfaces of inserts 34 and the walls of sockets 48 retain inserts 34 within sockets 48. To insure that sockets 48 can withstand encountered drilling stresses without becoming deformed, a minimum thickness 50 of cone cutter material separates the closest portions of adjacent sockets 48. For one embodiment, minimum thickness 50 is approximately one eighth of an inch (⅛").

As discussed in more detail below, the oblong shape of inserts 34 prohibits rotation of inserts 34 within their respective sockets 48, and allows forming a chisel crest of the desired length on each insert 34 while maintaining the desired thickness 50 and the desired number of inserts 34 with an annular row.

Figure 2:
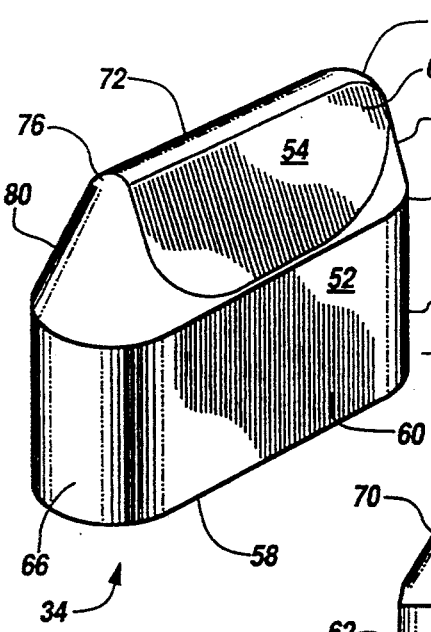
FIG. 2 is an isometric view of an insert embodying the novel features of the present invention.
Figure 3:
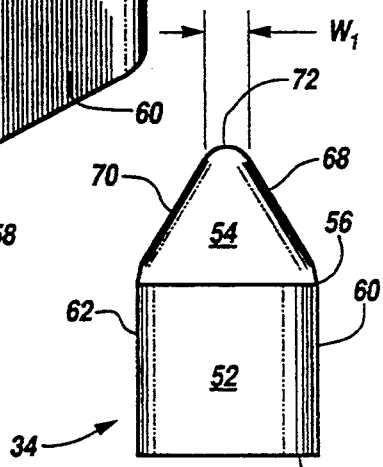
FIG. 3 is a front elevational view of the insert shown in FIG. 2.
Figure 4:
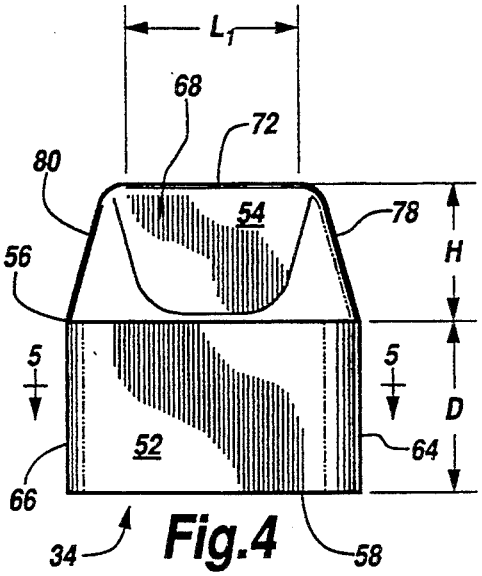
FIG. 4 is a side elevational view of the insert shown in FIG. 2.

Referring to FIGS. 2–4, isometric, front elevational, and side elevational views are shown of insert 34, which embodies the novel features of the present invention. Inserts 34 are typically formed from a hard material, such as hard metal, that is resistant to the abrasion caused by abrasive downhole formations, such as those having large amounts of grainy sand. One such hard metal is sintered tungsten carbide that is compacted into inserts 34. For some applications, inserts 34 may be referred to as "compacts". These hard-metal inserts 34 typically last much longer in abrasive formations than do milltooth bits, which are typically formed from a relatively soft metal used to manufacture the respective cone cutter that may be thinly coated with an abrasion-resistant material. Abrasive formations quickly wear away this thin coating, and then even more quickly wear away the exposed milltooth bits.

Insert 34 has a base 52 of depth D for insertion into a socket 48 and a cutting tip or chisel 54, which protrudes a height H from the cone cutter surface. Base 52 includes a top 56, a bottom surface 58, substantially parallel front and rear surfaces 60 and 62, and curved opposing side surfaces 64 and 66. Chisel 54 includes front and rear flank surfaces 68 and 70, a crest 72 formed at the convergence of flank surfaces 68 and 70 and having opposing ends 74 and 76, width W1, and length L1, and opposing curved end surfaces 78 and 80.

Flanks 68 and 70 are singular planar surfaces that ascend longitudinally from top 56 and converge to form crest 72. Although crest 72 is shown having a rounded surface, crest 72 may have a surface of another shape, such as flat or pointed. Surfaces 58, 60, and 62 are also substantially planar.

Figure 5:
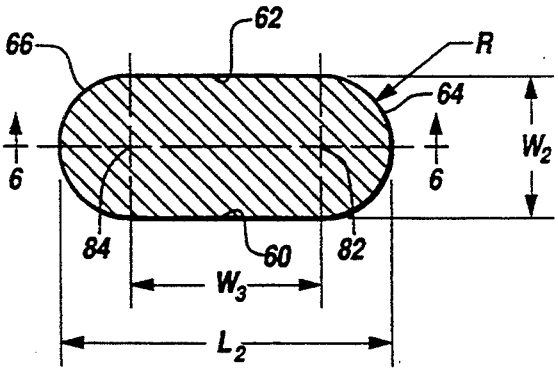
FIG. 5 is a plan view of the insert of FIG. 2 taken substantially along line 5—5 of FIG. 4.

Referring to FIG. 5, a plan view is shown of insert 34 taken along line 5—5 of FIG. 4. Because inserts 34 and sockets 48 are closely sized for an interference fit, FIG. 5 also substantially represents a plan view of a socket 48 normal to the cone cutter surface. In general, insert 34 may be constructed in various noncylindrical shapes, but is typically either generally oval or rectangular in shape as viewed along line 5—5 of FIG. 4.

As shown in FIG. 5, base 52 has a length L2 along its major axis and a width W2 along its minor axis where the major axis is substantially longer than the minor axis. Opposing sides 64 and 66 are semicylinders having a radius R substantially equal to W2/2, and are tangent with front and rear surfaces 60 and 62. Central axes 82 and 84 of sides 64 and 66 are shown separated by a distance W3, which is also the length of front and rear surfaces 60 and 62.

Figure 6:
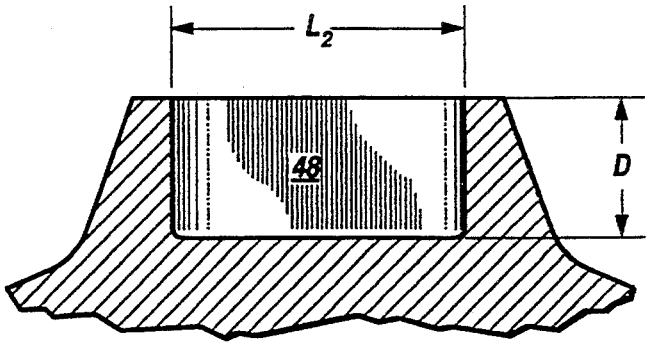
FIG. 6 is a cross-sectional view of a socket formed in the exterior of a cone cuter for receiving the insert shown in FIG. 5.

Referring to FIG. 6, a cross-sectional view of a socket 48 is shown taken substantially along line 6—6 of FIG. 5. As shown, socket 48 has substantially the same width W2, length L2, and depth D as base 52 of insert 34. Socket 48 is oriented within the surface of a cone cutter 10, 12, or 14 such that axes 82 and 84 are approximately normal to the surface when insert 34 is properly press fitted into socket 48.

In order to provide insert 34 with an oblong shape for prohibiting its rotation within socket 48, distance W3 is greater than zero. Furthermore, as is discussed below in conjunction with FIGS. 7–11, W3 is preferably greater than radius R to reduce or inhibit the tendency of a drill to walk into a first hole 86 (drilled for forming a socket 48) when drilling a second hole 88.

Length L2 is from 1% to 75% longer and preferably 50% to 60% longer than width W2. For example, if W2=0.375", L2 is within the range from 0.378" to 0.656" and preferably within the range from 0.563" to 0.623". The actual values of L2 and W2 depend upon the crest 72 length and width L1 and W1.

To insure that a minimum thickness 50 (FIG. 1) of material separates sockets 48, depth D should be no longer than 125% of W2, and is preferably approximately 80% of W2. For example, if W2=0.375", then depth D should be no longer than 0.375"×1.25=0.469" and is preferably 0.375"×0.8=0.3".

Generally, height H of cutter portion 54, which protrudes from socket 48, is approximately equal to depth D and should not exceed approximately 125% of width W2. Thus, as the desired height H increases, so should depth D and width W2 increase. However, as D and W2 increase, the number of sockets 48 that may be placed within an annular row (such as rows 28, 36, and 38 of cone cutter 10) decreases. This decrease is necessary to maintain the minimum distance 50 between the closest points of adjacent sockets 48.

The present elongated design of inserts 34 allows a greater number of inserts 34 to be placed within an annular row than would be possible with cylindrical inserts having the same crest 72 length L1. Thus, inserts 34 for cutting highly abrasive formations can be formed with dimensions and hence cutting characteristics similar to those of milled teeth, which wear much more quickly in abrasive formations than do inserts 34.

Figure 7:
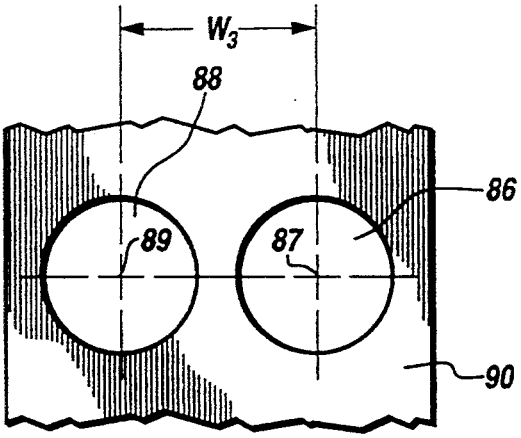
FIGS. 7–10 illustrate process steps for forming the socket shown in FIG. 6.

Referring to FIGS. 7–10, a procedure for forming a socket 48 is illustrated. As shown in FIG. 7, a first hole 86 having a center axis 87 and a second hole 88 having a center axis 89 are drilled into surface 90 of a cone cutter 10, 12, or 14. As shown, axes 87 and 89 are separated by distance W3, as are axes 82 and 84 of FIG. 5. Ideally, when an insert 34 is installed, axes 82 and 87 will be equivalent, as will be axes 84 and 89.

Figure 8:
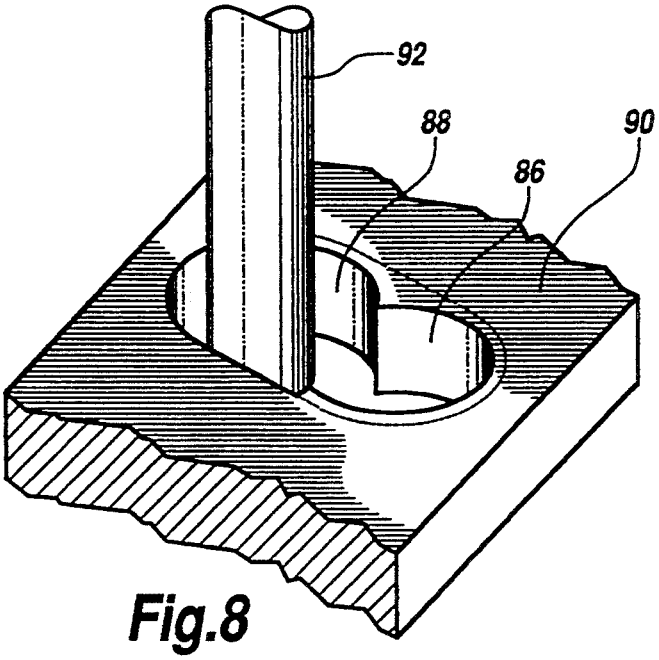

Referring to FIG. 8, a mill cutter tool 92 then increases the diameters of holes 86 and 88 by an additional few thousands of an inch and also removes the material separating holes 86 and 88. Typically, tool 92 is controlled by a numerically controlled machine having the ability to interpolate the cutter tool path.

Figure 9:
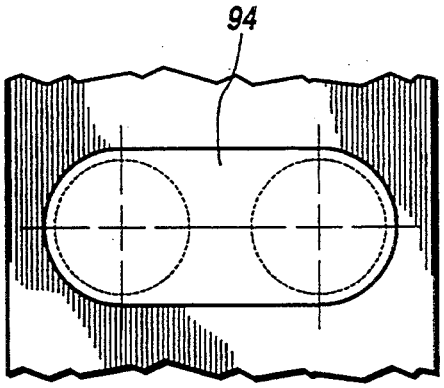

FIG. 9 shows the material 94 removed by mill cutter tool 92 during the milling step illustrated in FIG. 8.

Figure 10:
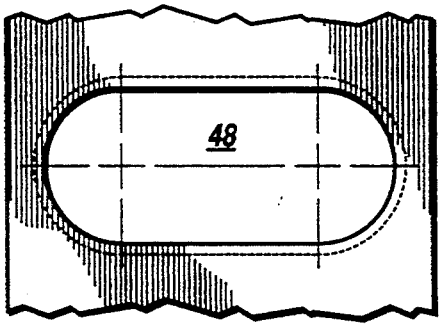

Referring to FIG. 10, in the final step, mill cutter tool 92 removes a few additional thousandths of an inch around the perimeter of socket 48 where indicated by the dashed lines and arcs. Although this additional material may be removed in the step illustrated in FIG. 8, performing the milling in multiple steps allows width W2 and length L2 to be milled within very close tolerances.

Figure 11:
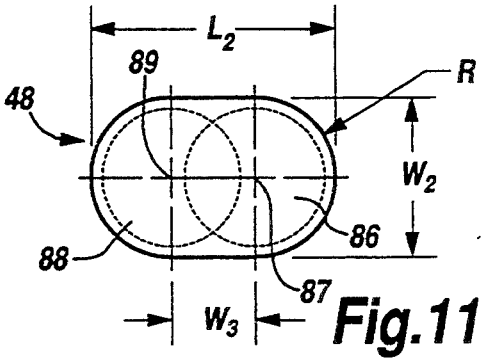
FIG. 11 is a plan view of an alternate form of the socket shown in FIG. 6.

FIG. 11 illustrates an alternative embodiment of socket 48 in accordance with the present invention. The distance W3 between centers 87 and 89 of drilled holes 86 and 88 is approximately equal to both radius R and $$\frac{W2}{2}.$$

For alternative socket 48, length L2 is approximately 50% longer than W2. For example, if W2=0.375", the L2=0.375"×1.5=0.563". Alternative socket 48 has an oblong shape, which prohibits rotation of a corresponding cutter insert within alternative socket 48 and allows the insert to have a desired crest length while maintaining the desired minimum clearance between sockets and the desired number of inserts with a row.

As stated, the interpolating feature of the milling machine maintains very close tolerances for the dimensions of socket 48. These close tolerances insure a proper interference fit of an insert 34 within a socket 48. Also, a noncylindrical insert 34 is confined in a noncylindrical socket 48. Therefore, the noncylindrical shape alone prohibits the rotation of an insert 34 within a socket 48; additional parts, such as pins, sleeves, or projections from the insert, are not required to keep an insert 34 properly oriented. Furthermore, not only is a noncylindrically shaped base and socket useful to prevent rotation of inserts having chisel cutting portions, but such a base and socket is also useful to prevent the rotation of an insert with a frustoconical cutting tip.

As further stated, the elongated shape of an insert 34 allows increases in crest width W1 and in crest length L1 such that an insert 34 can possess scraping and gouging capabilities similar to those of a milled tooth. Such capabilities allow the overall cutting structure of a bit using inserts 34 to more completely cover the bottom of the hole being drilled. Furthermore, the increases in crest width W1 and crest length L1 are realized without reducing depth D or the number of inserts 34 within a row to maintain the minimum thickness 50 separating adjacent sockets 48 and inserts 34. A reduction in depth D would weaken the fit between a base 52 and the walls of a socket 48; such a weakening might permit the drilling forces to more easily dislodge an insert 34 from its respective socket 48. A reduction in the number of inserts 34 within a row may reduce the cutting effectiveness of the drill bit.

Although the present invention and its advantages have been described in detail, it should be understood that various changes, substitutions and alterations can be made therein without departing from the spirit and scope of the invention as defined by the appended claims.

What is claimed is:

1. An insert for mounting within a socket formed in a cone cutter, said insert comprising: a base having a top, length, width, and depth and sized to have an interference fit with said socket;

a chisel-shaped cutting tip integrally formed with said base and protruding outwardly of said socket when said base is mounted therein said cutting tip, comprising, front and rear flank surfaces extending and converging outwardly from said top, a crest having opposing ends and formed at said convergence, parallel with said major axis, and substantially shorter than said major axis, and symmetric opposing end surfaces each extending between said flank surfaces, one of said opposing ends, and said top; and wherein said length substantially differs from said width.

2. The insert of claim 1 wherein said depth is greater than 0.8 times said width.

3. The insert of claim 1 wherein said length is substantially between 1.5 and 1.6 times said width.

4. The insert of claim 1 wherein said length is substantially less than or equal to 1.75 times said width.

5. The insert of claim 1 wherein said depth is substantially between 1 and 1.25 times said width.

6. The insert of claim 1 wherein said base and said cutting tip are formed from a hard metal.

7. An insert formed from hard material for mounting within a socket milled in the surface of a cone cutter, said insert comprising:

a base sized to be received within said socket with an interference fit, the base comprising, a top, a bottom surface, a front surface extending between said bottom surface and said top, a rear surface opposite said front surface and extending between said bottom surface and said top, and opposing side surfaces extending between said front surface, said rear surface, said bottom surface, and said top, and wherein said base has a major axis extending between said opposing side surfaces and a minor axis extending between said front and rear surfaces, said major axis substantially longer than said minor axis; and a chisel integrally formed with said base, comprising, front and rear flank surfaces extending and converging outwardly from said top, a crest having opposing ends and formed at said convergence, parallel with said major axis, and substantially shorter than said major axis, and symmetric opposing end surfaces each extending between said flank surfaces, one of said opposing ends, and said top.

8. The insert of claim 7 wherein said opposing side surfaces are cylindrical segments tangent to said front and rear surfaces.

9. The insert of claim 8 wherein said cylindrical segments have equivalent radii.

10. The insert of claim 7 wherein said front surface is generally parallel to said rear surface.

11. The insert of claim 7 wherein the length of said major axis is generally between 1.5 and 1.6 times the width of said minor axis.

12. The insert of claim 7 wherein the length of said major axis is generally less than or equal to 1.75 times the width of said minor axis.

13. The insert of claim 7 wherein the depth of said base between said top and said bottom surface is generally between 1.0 to 1.25 times the height of said chisel between said top and said crest.

14. The insert of claim 7 wherein said crest has a rounded surface.

15. A cone cutter for rotating about a spindle of a rotary cone drill bit, said cone cutter having a longitudinal axis and a surface, said cone cutter comprising:

a plurality of sockets arranged in at least one row disposed along said surface, each of said sockets having a major axis and a minor axis substantially shorter than said major axis; and a plurality of inserts each mounted with an interference fit within an associated one of said sockets, each of said cutting inserts comprising, a base having a top, a length, a width, and a first depth, a cutting tip integrally formed with said base for protruding outwardly of said one of said sockets when said base is mounted therein said cutting tip comprising, front and rear flank surfaces extending and converging outwardly from said top, a crest having opposing ends and formed at said convergence, parallel with said major axis, and substantially shorter than said major axis, and symmetric opposing end surfaces each extending between said flank surfaces, one of said opposing ends, and said top, and wherein said length is substantially unequal to said width.

16. The cone cutter of claim 15 wherein:

each of said sockets has a bottom located at a second depth from said surface;

adjacent ones of said socket bottoms are separated by at least a minimum distance;

each of said inserts protrudes approximately a height from said surface; and the widths of said minor axes are substantially less than the diameters of a plurality of cylindrical sockets having bottoms at said second depth and separated from each other by at least said minimum distance, said cylindrical sockets for receiving cylindrical inserts each protruding approximately said height from said surface, such that the maximum possible number of said sockets in a row exceeds the maximum possible number of said cylindrical sockets in said row.

17. The cone cutter of claim 15 wherein said row lies along a path concentric with said longitudinal axis.

18. The cone cutter of claim 17 wherein said major axes are substantially perpendicular to said path.

19. The cone cutter of claim 17 wherein at least one of said major axes forms an oblique angle relative to said path.

20. The cone cutter of claim 15 wherein said cutter inserts protrude substantially equivalent heights from said surface, said heights less than or equal to approximately 1.25 times said width.

* * * * *